US008714407B2

(12) United States Patent
Frank et al.

(10) Patent No.: US 8,714,407 B2
(45) Date of Patent: May 6, 2014

(54) DEVICE FOR DISPENSING MATERIAL FROM A DEFORMABLE TUBE

(75) Inventors: John W. Frank, Cottage Grove, MN (US); Michael C. Molinet, Woodbury, MN (US); Byron E. Trotter, St. Paul, MN (US); Diane R. Wolk, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 129 days.

(21) Appl. No.: 13/152,934

(22) Filed: Jun. 3, 2011

(65) Prior Publication Data

US 2011/0297697 A1 Dec. 8, 2011

Related U.S. Application Data

(60) Provisional application No. 61/351,582, filed on Jun. 4, 2010.

(51) Int. Cl.
*B65D 35/28* (2006.01)
*B65D 35/56* (2006.01)

(52) U.S. Cl.
USPC ..... 222/103; 222/105

(58) Field of Classification Search
CPC ..... B65D 35/28; B65D 35/56
USPC ..... 222/105, 214, 103, 183
See application file for complete search history.

(56) References Cited

U.S. PATENT DOCUMENTS

| | | | | |
|---|---|---|---|---|
| 1,510,848 | A * | 10/1924 | Hubbard | 222/103 |
| 2,210,226 | A * | 8/1940 | Weisberger | 222/103 |
| D199,606 | S | 11/1964 | Waterman | |
| D207,189 | S | 3/1967 | Thomson | |
| D217,803 | S | 6/1970 | Douglas | |
| 3,536,234 | A * | 10/1970 | Rise Leif | 222/103 |
| D221,213 | S | 7/1971 | Weckman | |
| D226,551 | S | 3/1973 | Weckman | |
| 4,172,536 | A * | 10/1979 | Holt | 222/103 |
| D257,828 | S | 1/1981 | Strand | |
| D266,702 | S | 10/1982 | Lagny | |

(Continued)

FOREIGN PATENT DOCUMENTS

| | | |
|---|---|---|
| EP | 521200 | 1/1993 |
| JP | 2003-020078 | 1/2003 |

(Continued)

OTHER PUBLICATIONS

International Search Report for PCT/US2011/039113, Mailing Date Feb. 9, 2012, 3 pages.

*Primary Examiner* — Paul R Durand
*Assistant Examiner* — Matthew Lembo
(74) *Attorney, Agent, or Firm* — Lisa P. Fulton; Robert H. Jordan

(57) ABSTRACT

Devices for dispensing material from a deformable tube comprise a shell having a top portion and a bottom portion. The shell comprises two shell pieces, the shell defining a compartment adapted for receiving a deformable tube and having an aperture in its top portion. Each shell piece comprises a press portion having a groove surrounding the press portion and a hinge located in the bottom portion connecting the press portion to the shell piece. The inner surfaces of the press portions have pressing features configured to squeeze a deformable tube from the bottom of the tube to the top of the tube.

20 Claims, 4 Drawing Sheets

(56) References Cited

U.S. PATENT DOCUMENTS

| | | | | |
|---|---|---|---|---|
| 5,170,911 | A | 12/1992 | Della Riva | |
| 5,195,660 | A * | 3/1993 | Lekes | 222/103 |
| 5,322,194 | A * | 6/1994 | Roberts | 222/103 |
| 5,454,486 | A * | 10/1995 | Mack et al. | 222/95 |
| 5,505,342 | A | 4/1996 | Okamura | |
| 5,622,283 | A * | 4/1997 | Morrison | 222/103 |
| 5,862,949 | A * | 1/1999 | Markey et al. | 222/143 |
| D424,115 | S | 5/2000 | Kuboshima | |
| D428,342 | S | 7/2000 | Stoller | |
| 6,315,165 | B1 * | 11/2001 | Regan | 222/103 |
| 6,510,965 | B1 | 1/2003 | Decottignies | |
| 6,669,055 | B1 * | 12/2003 | Coleman et al. | 222/103 |
| D484,808 | S | 1/2004 | Thierjung | |
| D485,480 | S | 1/2004 | Rushe | |
| D496,279 | S | 9/2004 | Hama | |
| D497,107 | S | 10/2004 | Hama | |
| 6,968,978 | B1 * | 11/2005 | Matthews | 222/103 |
| 7,077,292 | B2 * | 7/2006 | Turano | 222/103 |
| D546,189 | S | 7/2007 | Costello | |
| D557,340 | S | 12/2007 | Nagahama | |
| D564,892 | S | 3/2008 | Robilant | |
| 7,766,190 | B2 | 8/2010 | Chen | |
| D624,421 | S | 9/2010 | Berger | |
| D642,475 | S | 8/2011 | Crutchley | |
| 8,056,748 | B2 * | 11/2011 | Chen | 220/254.1 |
| 2004/0035880 | A1 | 2/2004 | Coleman | |
| 2004/0173558 | A1 | 9/2004 | Chen | |
| 2007/0034645 | A1 * | 2/2007 | Kafcsak | 222/103 |
| 2007/0218229 | A1 | 9/2007 | Nagahama | |
| 2009/0001098 | A1 | 1/2009 | Chen | |
| 2009/0179031 | A1 | 7/2009 | Chen | |

FOREIGN PATENT DOCUMENTS

| | | |
|---|---|---|
| JP | 2003-226374 | 8/2003 |
| JP | 2004-182249 | 7/2004 |
| JP | D 1313228 | 10/2007 |
| TW | 595581 | 6/2004 |
| TW | M328262 | 3/2008 |
| TW | M329022 | 3/2008 |
| TW | M337466 | 8/2008 |
| WO | WO 2007-113244 | 10/2007 |

* cited by examiner

DEVICE FOR DISPENSING MATERIAL FROM A DEFORMABLE TUBE

CROSS REFERENCE TO RELATED APPLICATION

This application claims the benefit of U.S. Provisional Patent Application No. 61/351,582, filed Jun. 4, 2010, the disclosure of which is incorporated by reference herein in its entirety.

FIELD

This invention relates to devices for dispensing material such as, for example, glue from a deformable tube.

BACKGROUND

Deformable tubes (for example, aluminum tubes) are often used for containing and dispensing liquids and gels such as, for example, adhesives. It can be difficult, however, to regulate the flow of adhesives or other materials out of deformable tubes. Dispensing adhesives from them can therefore be messy, resulting in wasted adhesive. In addition, the user may not squeeze the tube in the correct area and some of the adhesive can remain trapped in the bottom of the tube.

Various devices have been developed in an attempt to control delivery of liquids and gels from deformable tubes. Typically these devices comprise a container or casing with buttons or a gripping jaw. A deformable tube is placed within the container or casing and the buttons or jaws are then activated to expel the contents of the tube in a relatively controlled manner. Examples of such devices are described in U.S. Patent Application Publication Nos. 2007/0218229 (Nagahama et al.) and 2009/0179031 (Chen), and European Patent Application Publication No. 0 521 200. Often, however, these devices include multiple parts and are relatively expensive and complicated to manufacture and/or assemble.

Another approach that has been developed for providing controlled delivery from deformable tubes involves placing an internal stiffener (for example, a tube with openings therethrough or an open coil) in the tube. The internal stiffener acts like a spring, which helps the tube walls rebound after the tube is squeezed. Presumably, this creates a vacuum inside the tube, thereby sucking back adhesive and stopping flow. But, the internal stiffener does not address the issue of higher viscosity adhesives becoming trapped at the bottom of the tube.

SUMMARY

In view of the foregoing, we recognize that there is a need for improved devices for dispensing material such as adhesives from a deformable tube.

Briefly, in one aspect, the present invention provides a device for dispensing material from a deformable tube comprising a shell having a top portion and a bottom portion and comprising two shell pieces. The shell defines a compartment adapted for receiving a deformable tube and has an aperture in its top portion through which the discharge outlet of the tube may extend. Each shell piece comprises a press portion having a groove surrounding the press portion and a hinge located in the bottom portion connecting the press portion to the shell piece. The inner surfaces of the press portions have pressing features configured to squeeze a deformable tube from the bottom of the tube to the top of the tube.

In another aspect, the present invention provides another device for dispensing material from a deformable tube. The device comprises a shell having a top portion and a bottom portion. The shell defines a compartment adapted for receiving a deformable tube and has an aperture in its top portion and an aperture in its bottom portion. The shell comprises two press portions. Each press portion has a groove surrounding the press portion and a hinge located in the bottom portion of the shell connecting the press portion to the shell. The inner surface of each press portion has pressing features configured to squeeze a deformable tube from the bottom of the tube to the top of the tube.

In yet another aspect, the present invention provides a device for dispensing material from a deformable tube containing an internal stiffener. The device comprises a shell having a top portion and a bottom portion and comprising two shell pieces. The shell defines a compartment adapted for receiving a deformable tube and has an aperture in its top portion. Each shell piece comprises a press portion having a groove surrounding the press portion and a hinge located in the bottom portion connecting the press portion to the shell piece. The inner surfaces of the press portions have pressing features configured to press against the stiffener of a deformable tube containing an internal stiffener.

In still another aspect, the present invention provides another device for dispensing material from a deformable tube containing an internal stiffener. This device comprises a shell having a top portion and a bottom portion. The shell defines a compartment adapted for receiving a deformable tube and has an aperture in its top portion and an aperture in its bottom portion. The shell comprises two press portions. Each press portion has a groove surrounding the press portion and a hinge located in the bottom portion of the shell connecting the press portion to the shell. The inner surfaces of the press portions have pressing features configured to press against the stiffener of a deformable tube containing an internal stiffener.

The present invention also provides dispensers such as those described above but having only one press portion. In such embodiments, at least a portion of the inner surface of the shell (for example, the inner surface on the opposite of the press portion) preferably comprises press features similar to those on the press portion.

As used herein:

- "top" is used to refer generally to the end of the device from which the discharge outlet of a deformable tube will extend when a deformable tube is placed within the device and "top portion" is used to refer generally to the top half of the device;
- "bottom" is used to refer generally to the end of the device that is opposite the top of the device and "bottom portion" is used to refer generally to the bottom half of the device;
- "inner surface" or "inside" is used to refer to the surface or region facing the tube when a deformable tube is placed within the compartment of the device; and
- "outer surface" or "outside" is used to refer to the surface or region facing away from the tube when a deformable tube is placed within the compartment of the device. The devices of the invention provide high precision dispensing of materials such as liquid and gel adhesives from deformable tubes while also minimizing adhesive waste. Advantageously, the devices of the invention comprise a simple construction that is ergonomic, easy to manufacture and assemble, and relatively low cost. The devices of the invention therefore meet the need in the art for improved devices for dispensing material such as adhesives from a deformable tube.

BRIEF DESCRIPTION OF THE DRAWINGS

The same structures across different embodiments are referred to by the same reference numbers in increments of 100.

DETAILED DESCRIPTION

One embodiment of the device of the present invention, which is useful for dispensing material from a deformable tube, comprises a shell that defines a compartment for receiving the deformable tube and that has an aperture at the top for the discharge outlet of the tube. The shell is typically made of a plastic material such as, for example, polypropylene, polyethylene, acrylonitrile butadiene styrene (ABS), polystyrene, and the like. Preferably, the shell is made out of polypropylene.

Figure 1A:
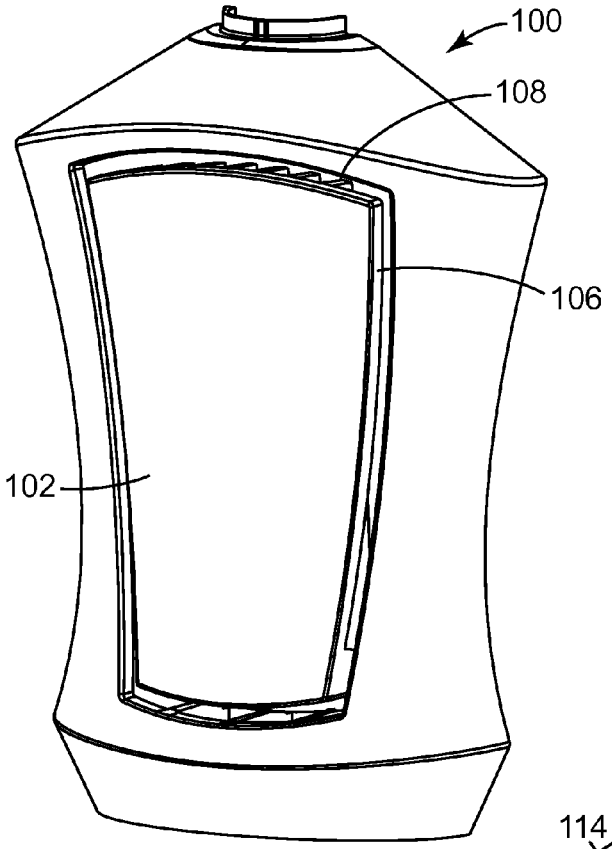
FIGS. 1A and 1B show the inner surface and the outer surface of a shell piece that is useful in the devices of the invention for dispensing material from a deformable tube.
Figure 1B:
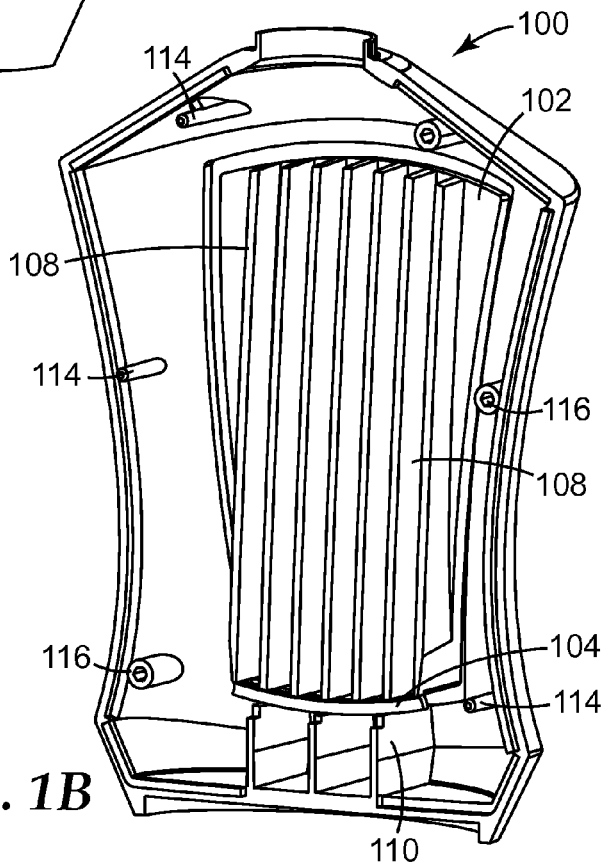

The shell comprises two shell pieces that mate together to form the shell and define the tube compartment. In some embodiments, the shell pieces are roughly equally sized halves. In some preferred embodiments, the two shell halves are identical. FIG. 1 illustrates an example of a shell piece half that is useful in the devices of the present invention. FIG. 1A shows the outer surface of shell piece 100 and FIG. 1B shows the inner surface of shell piece 100.

Shell piece 100 comprises press portion 102, which is connected to the remainder of shell piece 100 at the bottom of shell piece 100 by hinge 104 and surrounded by peripheral groove 106. Preferably, the press portion is an integral part (that is, not a separate piece) of the shell piece. As shown in FIG. 1, hinge 104 is a living hinge (that is, a thin flexible web of plastic that joins two relatively rigid bodies together). In other embodiments, however, the press portion may not be an integral part of the shell piece. In such embodiments, the press portion can be attached to the shell piece by a mechanical hinge comprising moving components. The press portion can have any useful shape including, for example, a generally triangular, rectangular, polygonal, or oval shape. In some embodiments, the press portions are approximately as wide as the width of the deformable tube to be placed within the compartment. In other embodiments, the press portions are narrower or wider than the deformable tube.

When dispensing material from a deformable tube it is important to squeeze the tube systematically from its bottom to its top in order to use the material as completely as possible and not trap unused material at the bottom of the tube. Therefore, the press portions are hinged at the bottom portion of the shell piece and the inner surfaces of the press portions have press features 108 configured to squeeze a deformable tube from the bottom of the tube to the top of the tube. By squeezing from the bottom towards the top of the tube, precision of dispensing is significantly increased because only as much of the tube as is necessary to dispense the tube's content is squeezed.

Figure 2:
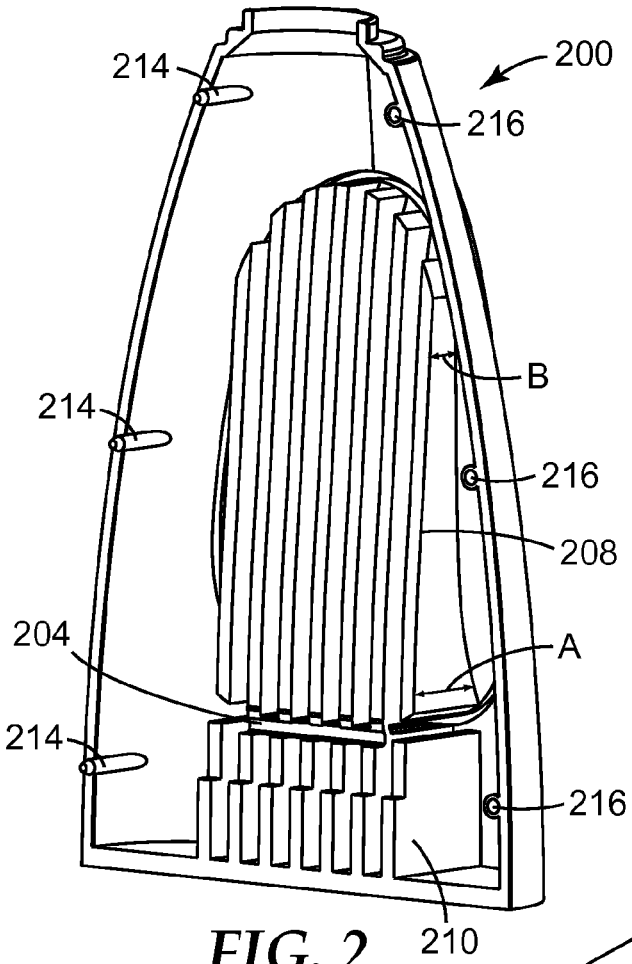
FIG. 2 shows another shell piece that is useful in the devices of the invention for dispensing material from a deformable tube.
Figure 5:
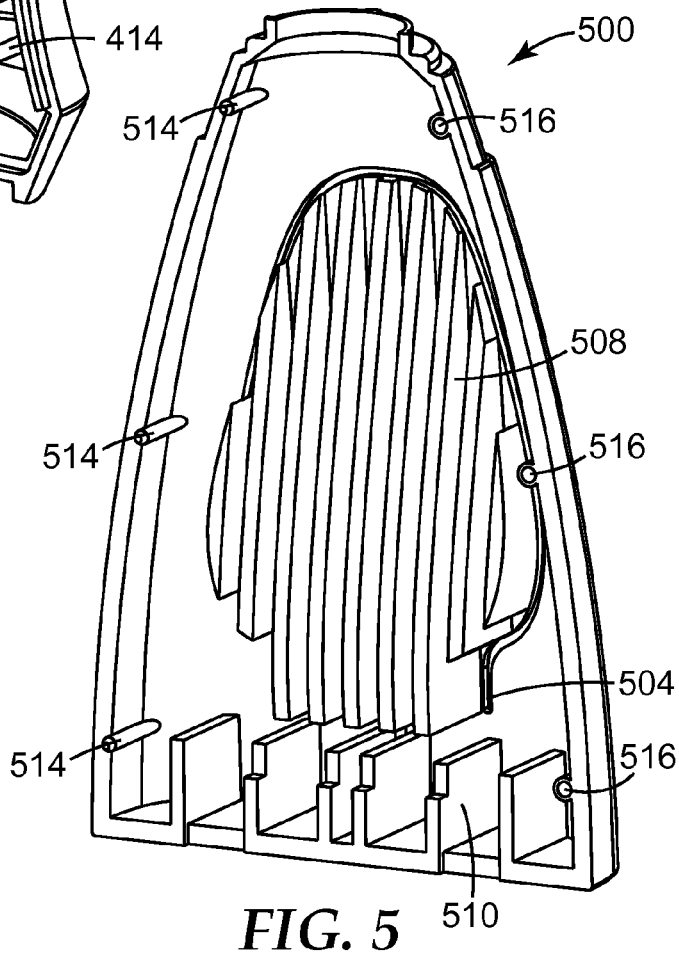
FIG. 5 shows another shell piece that is useful in the devices of the invention for dispensing material from a deformable tube.

In some embodiments, such as in shell piece 200 in FIG. 2, press features 208 comprise ribs that are thicker at their bottoms (width "A") than at their tops (width "B"). In other embodiments the press features comprise a solid surface, bosses, cross hatches, or any other useful configuration. It can also be advantageous to locate the hinges as close to the tube as possible so that the press features can flatten the tube and squeeze as much material as possible out of the tube. Therefore, in some embodiments such as the embodiment illustrated in FIG. 2, the axis of rotation of the hinge (204) is located at the inner surface of the shell piece in order to allow better rotation about the bottom of the tube. In other embodiments, however, such as the embodiment illustrated in FIG. 5, the axis of rotation of hinge 504 is located at the outer surface of the shell piece.

Preferably, the device for dispensing material from a deformable tube includes a tube support feature (e.g., 210 in FIG. 2) that supports the tube and preferably prevents it from rotating during assembly and use of the device. Shell piece 100 in FIG. 1 includes tube support feature 110, which is located toward the bottom of shell piece 100. Support feature 110 supports the bottom of the tube. Support feature 110 acts as a shelf to support the bottom of the tube. In other embodiments, the support feature may be a portion of the shell piece that angles in to pinch the tube and hold it in place.

Figure 3:
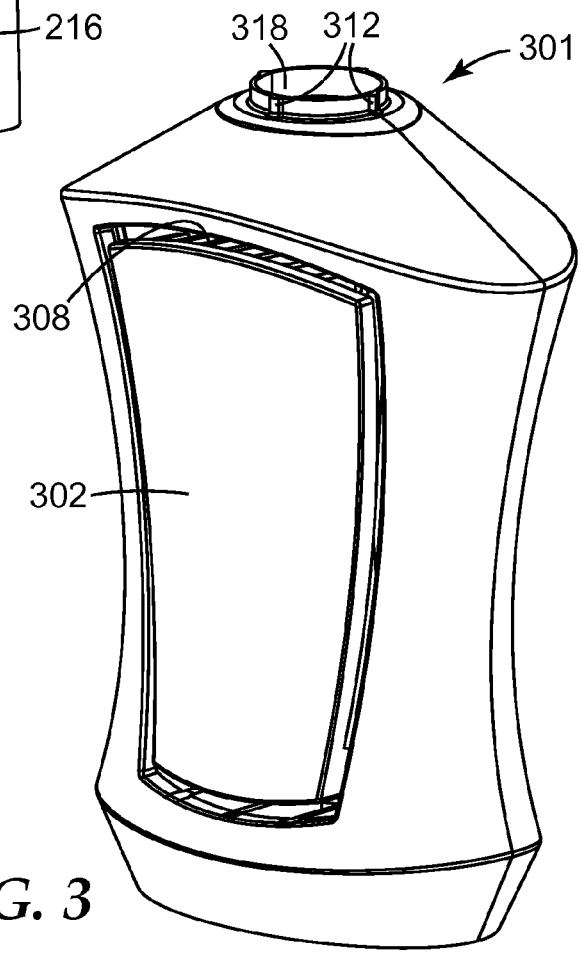
FIG. 3 shows a shell that is useful in the devices of the invention for dispensing material from a deformable tube.

In some embodiments, the top portion of the shell includes features around the neck of the shell for screwing a dispensing nozzle into place. For example, shell 301, as illustrated in FIG. 3, includes locking ramps 312 (on the neck of aperture 318) that are angled on one end to allow a dispensing nozzle (not shown) to screw into place. Once the nozzle engages with threads on the deformable tube (not shown) and passes over locking ramps 312, the nozzle will be locked into position, thereby preventing relative rotation between the nozzle, the tube and shell 301. In addition, the nozzle cannot be unscrewed from the tube.

Two shell pieces, which are preferably although not necessarily identical, mate together to form a compartment for the deformable tube. The shell pieces may comprise mating features such as pins and bosses or snaps. For example, shell half 100 in FIG. 1 includes pins 114 and bosses 116. Alternatively, or in addition, the shell halves may be glued together or ultrasonically welded.

The deformable tube to be placed within the device of invention can be made of any suitable deformable material such as, for example, metal or plastic. Deformable tubes can be used for containing and dispensing many liquid, gel and paste-like materials. They are regularly used, for example, with materials such as adhesives, toothpaste, cosmetics, caulks, mastics, putties (for example, for wood or auto repair), ointments, salves, and the like. Preferably, the deformable tube is made of a soft crushable metal such as, for example, aluminum alloy.

The bottom of the tube is typically left open and used for filling the contents of the tube. After filling, the bottom of the tube is closed and crimped or sealed. Metal tubes are typically crimped and then the flattened section of the tube can be folded in an S-shaped fold or an overlap fold. Plastic tubes may just be crimped shut using heat or may be ultrasonically welded.

As disclosed, for example, in U.S. Patent Application No. 2009/0001098, deformable tubes may be provided with an internal stiffener. Therefore, the present invention also provides a device for dispensing material from a deformable tube containing an internal stiffener. This device is typically configured to squeeze the portion of the tube containing the stiffener (versus devices designed for tubes without a stiffener that squeeze from the bottom of the tube up).

Figure 4:
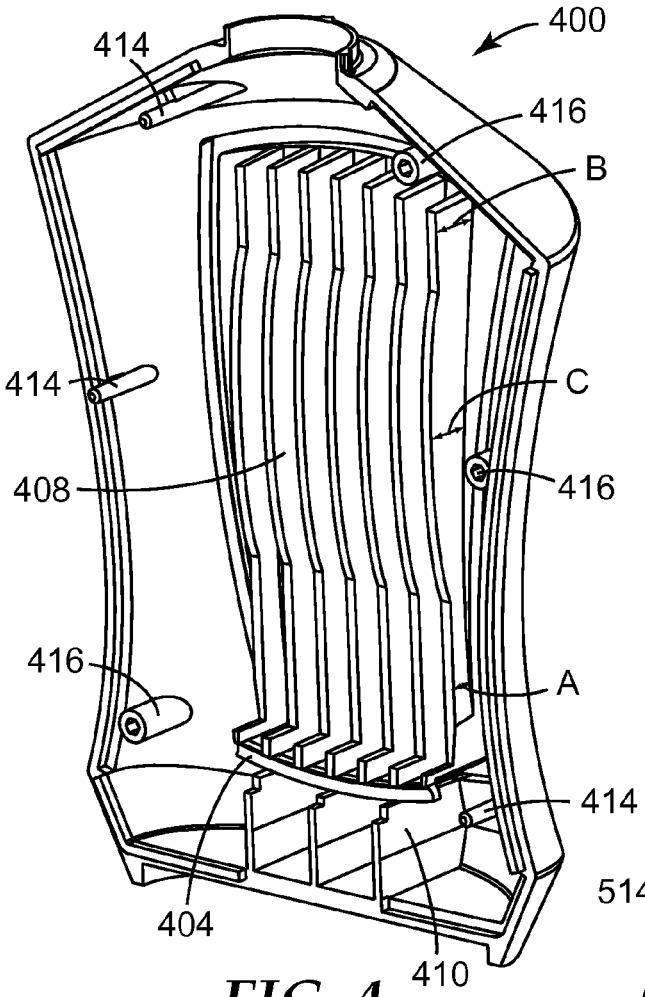
FIG. 4 shows the inner surface of a shell piece that is useful in devices of the invention for dispensing material from a deformable tube containing an internal stiffener.

As shown in FIG. 4, this device for dispensing material from a deformable tube is very similar to the devices described above. However, the inner surface of the press portion of shell piece 400 has pressing features 408 configured to press against the internal stiffener (for example, at the middle portion of the tube). Pressing features 408, for example, are thicker at their midsection (width "C") than at their tops (width "B") or bottoms (width "A").

Figure 6:
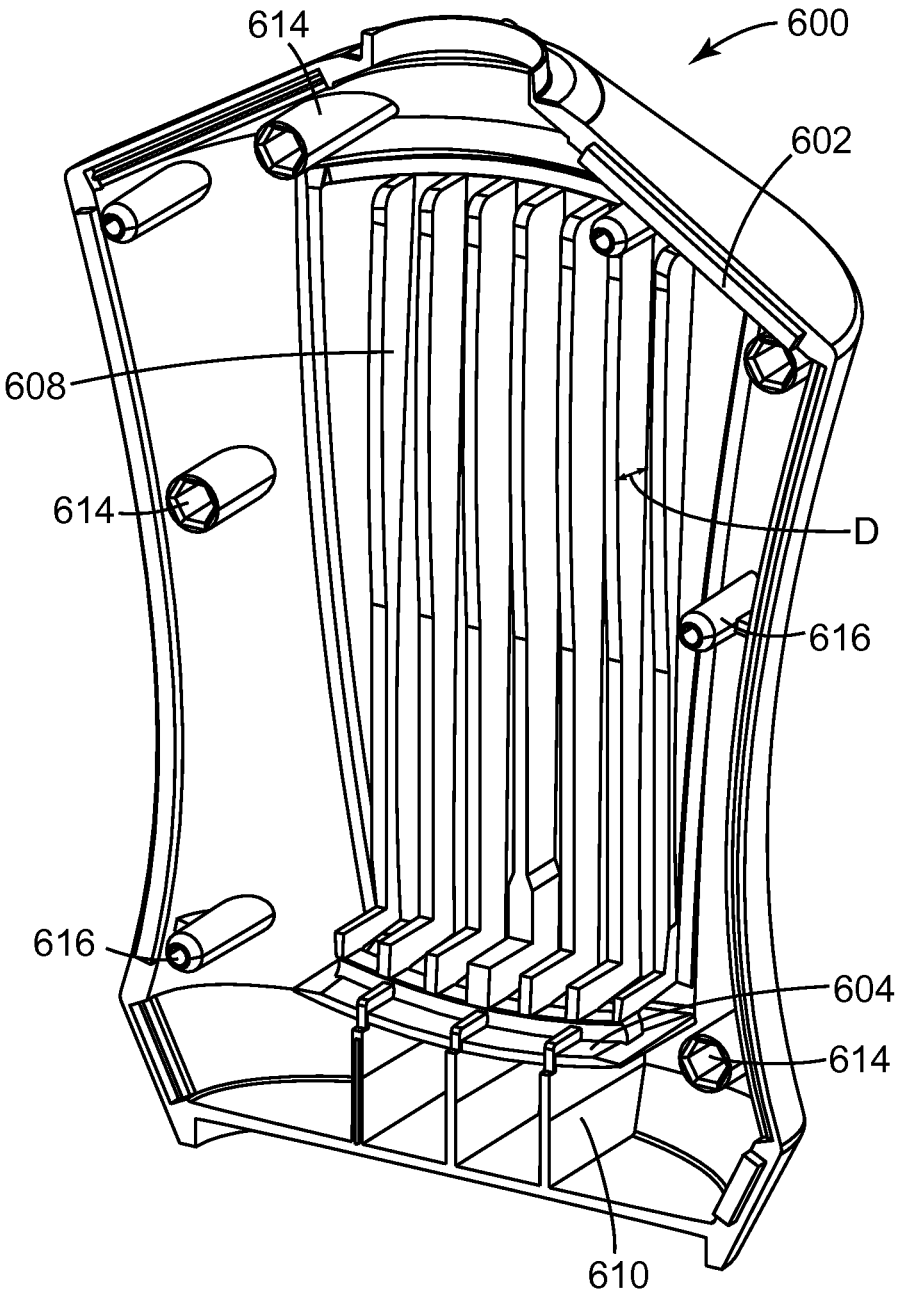
FIG. 6 shows another shell piece that is useful in devices of the invention for dispensing material from a deformable tube containing an internal stiffener.

FIG. 6 illustrates another embodiment of a device of the invention for dispensing material from a deformable tube containing an internal stiffener. In this embodiment, pressing features 608 are widest in the upper mid portion of the dispenser (width "D").

In some embodiments of the invention for dispensing material from a deformable tube containing an internal stiffener, the pressing features are configured to also press below the stiffener.

The devices of the invention are relatively easy and inexpensive to manufacture because of their simple construction. Each shell half may, for example, be molded as a single piece. The shell halves can be identical, thus eliminating the need for different molds.

The devices of the invention are also easy to assemble. The devices that comprise two shell pieces can be assembled with a deformable tube by placing the tube in one shell piece with the tube's discharge outlet or nozzle extending through the half-circle aperture at the top of the shell piece. The bottom of the tube may rest on a tube support feature if such support is present. The other shell piece can then be mated together with the first piece half thus enclosing the tube in the shell compartment. The shell pieces may be retained together using mating features, welding (for example, ultrasonic welding), adhesive, combinations thereof, or the like.

The devices of the invention wherein the shell comprises only one piece are also easy to assemble. The deformable tube can be inserted through the aperture at the bottom of the shell and pushed up into the shell so that the discharge outlet or nozzle extends through the top aperture. Optionally, a bottom piece may then be used to close the bottom aperture. A clip may be used to hold the discharge outlet or nozzle in place until the device is used, or a nozzle or cap may be threaded on to hold the tube in place.

The devices of the invention are suitable for dispensing low viscosity liquids as well as higher viscosity gels and pastes from a deformable tube. In some embodiments, the deformable tube contains an adhesive such as a cyanoacrylate adhesive.

The devices of the invention may be used to dispense the contents of the deformable tube by simply pressing on or gently squeezing the press portions with the fingers.

EXAMPLES

Objects and advantages of this invention are further illustrated by the following examples, but the particular materials and amounts thereof recited in these examples, as well as other conditions and details, should not be construed to unduly limit this invention.

Examples 1-4

Metal tubes obtained from Cartell Chemical Co., Ltd, Chia-Yi Hsien, Taiwan, were filled with 4.5 g of 50,000 cP cyanoacrylate gel adhesive. The metal tubes were placed in dispensers of the invention as illustrated in FIG. 2. The dispensers were squeezed using two hands until no more adhesive came out. The dispensed adhesive was then weighed. The results are shown in Table 1.

Comparative Examples C1-C4

Four Loctite Super Glue Control™ dispensers are manufactured by Henkel Consumer Adhesives, Avon, Ohio, (model #01-30380), each containing 4 g of cyanoacrylate gel adhesive, were purchased at a retail store. The dispensers were squeezed using two hands until no more adhesive came out. The dispensed adhesive was then weighed. The results are shown in Table 1.

TABLE 1

| Example No. | Dispenser Type | Starting Weight of Adhesive in Tube (g) | Weight of Adhesive Dispensed from Tube (g) | Percent of Adhesive Dispensed |
|---|---|---|---|---|
| 1 | FIG. 2 | 4.5 | 3.1 | 70% |
| 2 | FIG. 2 | 4.5 | 3.1 | 70% |
| 3 | FIG. 2 | 4.5 | 3.3 | 72% |
| 4 | FIG. 2 | 4.5 | 3.3 | 72% |
| C1 | Loctite | 4.0 | 1.7 | 43% |
| C2 | Loctite | 4.0 | 1.7 | 43% |
| C3 | Loctite | 4.0 | 1.7 | 43% |
| C4 | Loctite | 4.0 | 2.4 | 60% |

The complete disclosures of the publications cited herein are incorporated by reference in their entirety as if each were individually incorporated. Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows.

We claim:

1. A device for dispensing material from a deformable tube comprising:

a shell having a top portion and a bottom portion and comprising two shell pieces, the shell defining a compartment adapted for receiving a deformable tube and having an aperture in its top portion;

wherein each shell piece comprises (i) a press portion surrounded by a peripheral groove that separates the press portion from, and is surrounded by, the remainder of the shell piece and (ii) a hinge located in the bottom portion connecting the press portion to the shell piece such that the press portion is capable of moving independently of the remainder of the shell piece, the inner surfaces of the press portions having pressing features configured to squeeze a deformable tube from the bottom of the tube to the top of the tube, wherein the pressing features are thicker at their bottoms than at their tops.

2. The device of claim 1 wherein each hinge is a living hinge.

3. The device of claim 1 wherein the axis of rotation of each hinge is located at the inner surface of the shell piece.

4. The device of claim 1 wherein the shell pieces are shell halves.

5. The device of claim 4 wherein the shell halves are identical.

6. The device of claim 1 wherein at least one shell piece comprises a tube support feature.

7. The device of claim 6 wherein the tube support feature is in the bottom portion of the shell piece.

8. The device of claim 1 wherein the shell pieces comprise mating features.

9. The device of claim 8 wherein the mating features comprise pins and bosses.

10. The device of claim 1 wherein the shell pieces are glued or welded together.

11. The device of claim 1 wherein the pressing features comprise ribs on their inner surface.

12. The device of claim 1 wherein the press portions are approximately as wide as the width of the deformable tube to be placed within the compartment.

13. The device of claim 1 further comprising a deformable tube within the compartment.

14. The device of claim 13 wherein the deformable tube is a metal tube.

15. The device of claim 13 wherein the deformable tube contains adhesive.

16. The device of claim 15 wherein the adhesive is liquid.

17. The device of claim 15 wherein the adhesive is a gel.

18. A device for dispensing material from a deformable tube containing an internal stiffener comprising:

a shell having a top portion and a bottom portion and comprising two shell pieces, the shell defining a compartment adapted for receiving a deformable tube and having an aperture in its top portion;

wherein each shell piece comprises (i) a press portion surrounded by a peripheral groove that separates the press portion from, and is surrounded by, the remainder of the shell piece and (ii) a hinge located in the bottom portion connecting the press portion to the remainder of the shell piece such that the press portion is capable of moving independently of the remainder of the shell piece, the inner surfaces of the press portions having pressing features configured to press against the stiffener of a deformable tube containing an internal stiffener.

19. The device of claim 18 wherein the pressing features are configured to also press below the stiffener of a deformable tube containing an internal stiffener.

20. The device of claim 18 wherein the axis of rotation of each hinge is located at the inner surface of the shell piece.

* * * * *